US009273894B1

(12) United States Patent
Whitty et al.

(10) Patent No.: US 9,273,894 B1
(45) Date of Patent: Mar. 1, 2016

(54) AUXILIARY WATER RESERVOIR FOR ICE MAKERS

(75) Inventors: Kevin F. Whitty, Cape Coral, FL (US); Michael S. Sisk, North Fort Myers, FL (US)

(73) Assignee: K&M ICE, LLC, Sarasota, FL (US)

( * ) Notice: Subject to any disclaimer, the term of this patent is extended or adjusted under 35 U.S.C. 154(b) by 0 days.

(21) Appl. No.: 13/275,622

(22) Filed: Oct. 18, 2011

(51) Int. Cl.

| | |
|---|---|
| ***B60H 1/32*** | (2006.01) |
| ***F25D 17/06*** | (2006.01) |
| *F25C 1/00* | (2006.01) |
| *F25C 5/00* | (2006.01) |
| *F25C 5/18* | (2006.01) |

(52) U.S. Cl.
CPC . *F25D 17/06* (2013.01); *F25C 1/00* (2013.01); *F25C 5/007* (2013.01); *F25C 5/18* (2013.01); *F25C 5/187* (2013.01)

(58) Field of Classification Search
CPC . F25D 2323/122; F25D 23/126; F25D 17/06; F25C 1/00; F25C 5/007; F25C 5/18; F25C 5/187
USPC ..... 62/66, 188, 337–339, 340, 344, 348
See application file for complete search history.

(56) References Cited

U.S. PATENT DOCUMENTS

| | | | | |
|---|---|---|---|---|
| 3,580,008 | A | 5/1971 | Barnard et al. | |
| 3,744,263 | A * | 7/1973 | Franck et al. | 62/98 |
| 4,815,941 | A * | 3/1989 | Fayo | 417/44.2 |
| 4,884,413 | A | 12/1989 | Quandt et al. | |
| 4,910,974 | A | 3/1990 | Hara | |
| 4,987,746 | A * | 1/1991 | Roberts | 62/137 |
| 5,927,099 | A | 7/1999 | Bosko | |
| 6,153,105 | A * | 11/2000 | Tadlock et al. | 210/650 |
| 6,539,742 | B2 | 4/2003 | Mitchell et al. | |
| 6,898,947 | B2 * | 5/2005 | Hebert | 62/348 |
| 6,952,937 | B2 * | 10/2005 | Choi et al. | 62/347 |
| 7,194,868 | B2 * | 3/2007 | Yoshida et al. | 62/66 |
| 7,841,198 | B2 * | 11/2010 | Bippus et al. | 62/233 |
| 2003/0010054 | A1 * | 1/2003 | Esch et al. | 62/354 |
| 2011/0036103 | A1 | 2/2011 | Bippus et al. | |
| 2011/0036115 | A1 | 2/2011 | Lee et al. | |

FOREIGN PATENT DOCUMENTS

| | | | |
|---|---|---|---|
| WO | WO 2008/0925268 | * | 8/2008 |

* cited by examiner

*Primary Examiner* — Jonathan Bradford
*Assistant Examiner* — Elizabeth Martin

(57) ABSTRACT

An auxiliary water reservoir system is disclosed for coupling with an ice making apparatus. The auxiliary water reservoir system comprises an auxiliary water reservoir. An auxiliary water supply conduit supplies water to the auxiliary water reservoir. A return conduit couples with the ice making apparatus and positions an excess water within the auxiliary water reservoir. An auxiliary water pump and auxiliary pump conduit positions the water and the excess water from the auxiliary water reservoir to the ice making apparatus. An auxiliary system controller is electronically coupled to a water inlet regulator and a water level sensor for maintaining a water level within the auxiliary water reservoir. The auxiliary water pump propels the water to the ice making apparatus for utilizing the water and the excess water.

12 Claims, 2 Drawing Sheets

AUXILIARY WATER RESERVOIR FOR ICE MAKERS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to recirculating ice making equipment used to commercially produce large quantities of ice cubes, and more particularly to an auxiliary water reservoir system adapted to recover otherwise discharged excess water.

2. Description of Related Art

Commercial ice makers such as found in hotels, restaurants and other such commercial business establishments consume large amounts of supply water in order to produce ice cubes at the high rate demanded in commercial settings. These commercial ice makers depend upon a process of spraying or distributing water onto chilled freezer plates or molds wherein a significant amount of that spray water is lost during each freezing cycle and is drained off either back into the water reservoir for discharge or discharged directly into sewer drainage facilities. Each such excess water discharge can amount to tens if not hundreds of gallons of waste water being lost daily. In one actual example, a commercial ice machine has been shown to have wastefully discharged over 25,000 gallons of water yearly.

Ice makers are certified and rated in accordance with ARI Standard 810-91. Test conditions for standard ratings are 90° F. ambient air, 70° F. tap water, and about 30 psig water inlet pressure.

It is well known that productivity of an ice machine is in part a function of its ambient air temperature and of the temperature of the tap water used to make ice. The lower the temperature of the tap water, the higher the ice yield during each ice "harvest". In the vast majority of existing ice makers, a considerable volume of unused 33°-34° F. cold waste water is now being wastefully discharged at the end of one or more harvest cycles, even though it has long been suggested to utilize the cold energy contained within the cold waste water for pre-chilling its tap water distribution.

Even if the air temperature remains the same, lowering the tap water temperature by about 20° F. can considerably increase the ice yield of the machine. A temperature drop of 30° F. in the summer has been a long-held desire of ice machine owners.

In addition to increasing the ice yield, other tangible benefits will be obtained, including savings on the amount of required floor space for the ice maker, on the cost and installation of the ice maker, and on the operating and maintenance expenses.

U.S. Pat. No. 5,927,099 to Bosko discloses a recirculating water purification system. Lee et al. teach an icemaker having a water purifier in U.S. Patent Application Publication 2011/0036115. An automatic ice making machine is taught by Hara in U.S. Pat. No. 4,910,974.

Mitchell et al. disclose an ice maker with magnetic water conditioner in U.S. Pat. No. 6,539,742. An icemaker with water distributor is taught by Barnard et al. in U.S. Pat. No. 3,580,008. U.S. Patent Application Publication 2011/0036103 to Bippus et al. discloses a method of operating an ice maker with water quantity sensing which appears to typify the prior art problem.

The present system provides for an auxiliary excess water recovery and reuse system which fully utilizes virtually all of the incoming supply water to produce high volumes of ice cubes from commercial ice making machines.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to an auxiliary water reservoir system for connection with a commercial ice making apparatus, the apparatus including a supply water for a main reservoir, an ice making assembly connected to receive a stream of water from the main reservoir, and being arranged to freeze a portion of the water stream and to discharge the unfrozen portion of the water stream, a conduit connected to the apparatus and the main water reservoir for returning the discharged portion of the water stream back to the main water reservoir, a main water pump connected to the main water reservoir and the ice making apparatus arranged to convey water away from the main reservoir to the ice making apparatus when the ice making apparatus is making ice and to periodically discharge excess water from the main reservoir. The system includes an auxiliary water reservoir, a water bypass conduit for controllably supplying water either to the auxiliary reservoir or to the main reservoir, and an auxiliary water pump for controllably conveying water from the auxiliary reservoir to the main reservoir. A system controller regulates supply water either into the auxiliary reservoir or the main reservoir depending upon the respective water level within each of these reservoirs.

It is therefore an object of this invention to recover and reuse large amounts of excess water otherwise lost from commercial ice cube making apparatus.

It is yet another object of this invention to conserve and recover excess water normally discharged to waste from commercial high-volume ice cube making apparatus without having to modify those existing ice making apparatus.

Still another object of this invention is to provide an auxiliary water reservoir system adapted for interconnection with a commercial ice making apparatus without the need for modification of the apparatus and which will recover and conserve large amounts of water which would otherwise normally be discharged to waste.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Nomenclature

Figure 1:
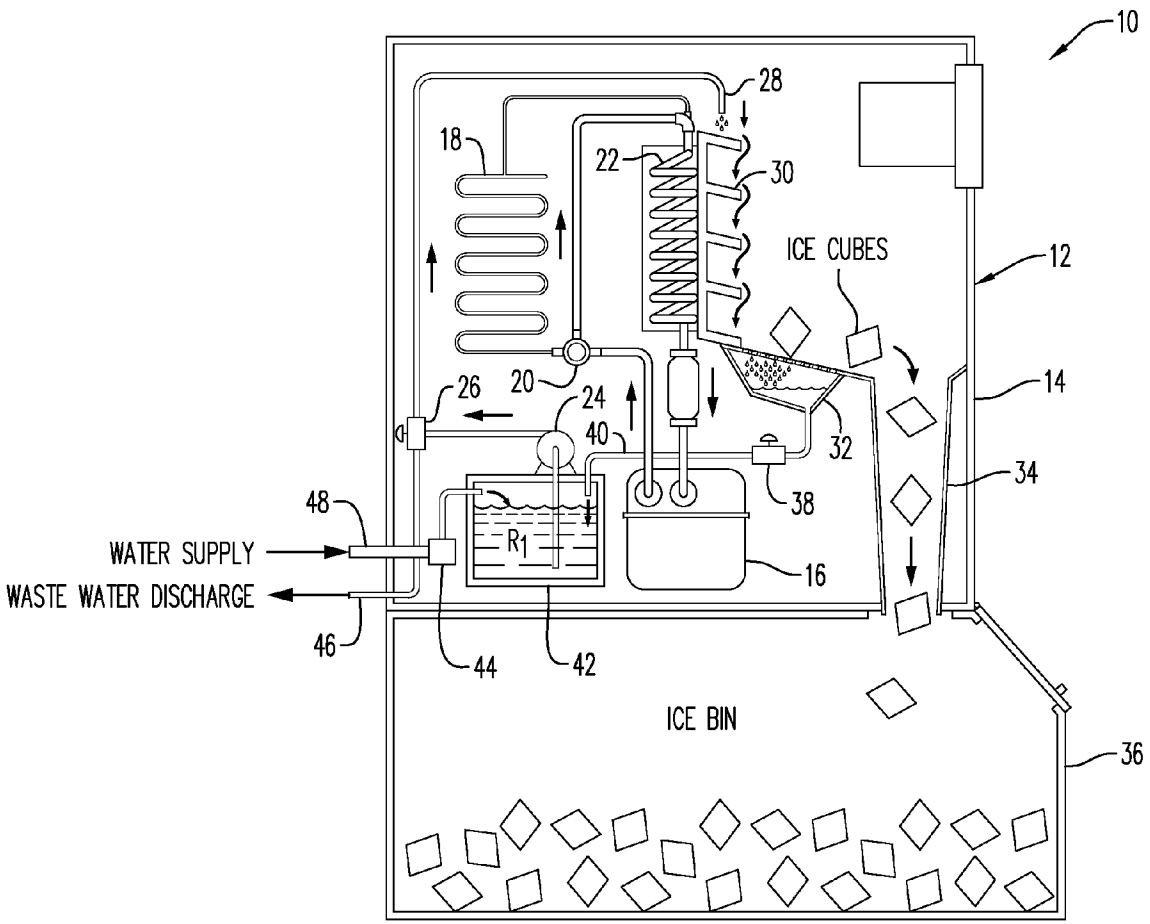
FIG. 1 (PRIOR ART)
FIG. 1 is a side elevation schematic view of a typical prior art commercial ice making machine.

10. prior art ice making apparatus
12. main housing assembly
14. housing
16. compressor
18. condenser coil
20. defroster valve
22. evaporator coil
24. primary water pump
26. three-way valve
28. water dispenser
30. ice cube forming trays
32. excess water trough
34. ice cube chute
36. ice cube bin
38. valve
40. excess water return conduit
42. main water reservoir
44. water inlet regulator
46. waste water discharge
48. water inlet
60. auxiliary water reservoir system
62. auxiliary water reservoir
64. auxiliary water pump
66. water pickup conduit
68. three-way valve
70. UV water treatment device
72. water inlet regulator
74. water level sensor
76. system controller
78. bypass conduit
80. three-way valve
82. waste water discharge
84. return conduit
86. T-fitting
88. drain valve
90. water inlet conduit Referring now to the drawings, and firstly to FIG. 1, a typical prior art commercial ice making machine is there shown generally at numeral 10 and includes a main housing assembly 12 having an exterior metal housing 14 and an ice bin 36 disposed therebeneath. Within the housing 14 is a compressor 16 operably connected to an evaporator coil 22 during the ice making cycle and, alternately as controlled by defroster valve 20, to a condenser coil 18 in a well known fashion.

A main reservoir (R1) 42 is also disposed within housing 14 which holds a supply of water received through a water inlet regulator 44 from a water supply 48. A primary water pump 24 is in fluid communication with water within the main reservoir 42 and is arranged to provide water flow through a three-way valve 26 to a water dispenser 28 which flows or sprays water over each of the chilled ice forming trays 30 as shown by the flowing arrows. At the end of each ice making cycle, ice cubes formed thereby are dislodged during a heating cycle and fall by gravity downwardly through an ice cube chute 34 into the ice bin 36. The excess water which is collected within an excess water trough 32, and has been controllably discharged through valve 38 back into the main reservoir 42, is pumped from the main reservoir 42 through the three-way valve 26 for discharge and disposal from a waste water discharge 46. It is this waste water discharge which must periodically occur during each complete ice cube making cycle which the present invention is designed to recover and reuse.

Figure 2:
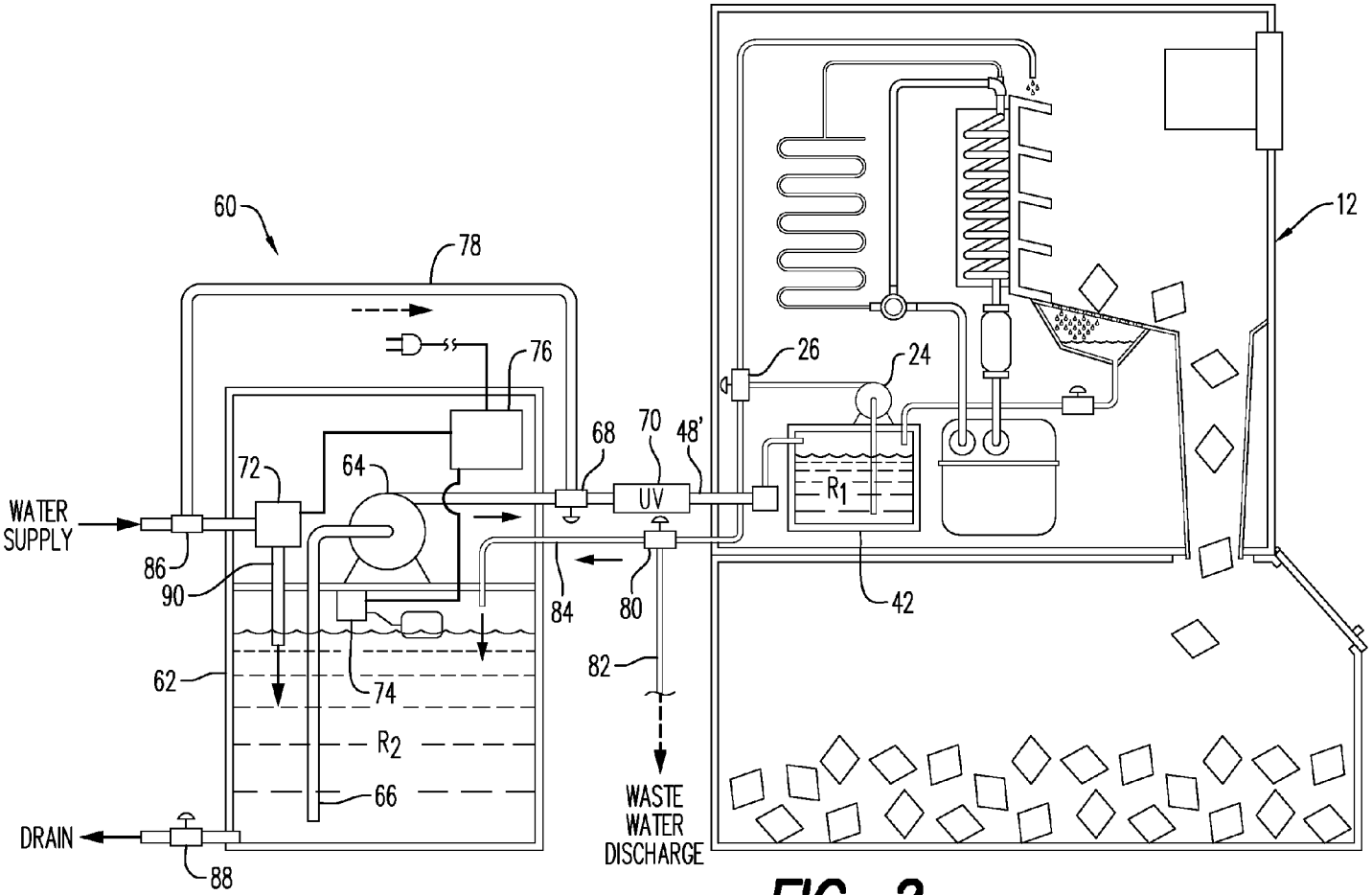
FIG. 2 is a side elevation view of FIG. 1 showing the auxiliary excess water recovery reservoir system interconnected therewith.

Referring now to FIG. 2, the auxiliary water reservoir system is shown generally at numeral 60 in separate, but preferably side-by-side arrangement with, the main housing assembly 12. The auxiliary water reservoir system 60 includes an auxiliary water reservoir (R2) 62 having an auxiliary water pump 64 disposed therein. Supply water now flows into the auxiliary water reservoir 62 through a water inlet regulator 72 from water inlet conduit 90. This regulator 72 is controlled by a system controller 76 which also senses and acts upon a water level signal from a water level sensor 74 within the auxiliary water reservoir 62.

Under normal operation during the ice cube forming cycle, supply water is pumped by the auxiliary water pump 64 into the main reservoir 42 through water inlet 48'. The remainder of the ice cube forming cycle within the main housing assembly 12 is as previously described with respect to FIG. 1. However, when the main water reservoir 42 is filled such that removal of excess water is required, the main water pump 24 pumps this excess water through three-way valve 26 back into the auxiliary reservoir 62 through the return conduit 84 as controlled by three-way valve 80. Alternately, when the auxiliary reservoir 62 is filled sufficiently, or the entire system must be pumped dry for cleaning and servicing, the water pumps from the main reservoir 42 will be discharged through a waste water discharge 82.

When the auxiliary reservoir 62 is sufficiently filled, the system controller 76 will cause supply water to be diverted to bypass conduit 78 and directed into the main reservoir 42. Preferably, an in-line UV water treatment device 70 is provided to ensure that all water being pumped into the main water reservoir 42 will have been properly decontaminated. The drain valve 88 disposed at the bottom of the auxiliary reservoir 62 is provided to completely drain all water from this reservoir 62 when cleaning and servicing of this unit is required.

Example

In a single prior art commercial ice making machine, having a single 22" evaporator, approximately 0.75 gallons of water is discharged onto the ground or into a sanitary waste system during each ice cube making cycle. On a 24-hour basis, this water waste equates to about 72 gallons of water lost per day, or 26,300 gallons yearly.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. An auxiliary water reservoir system for coupling with an ice making apparatus, the ice making apparatus including a housing containing a main reservoir and an ice making assembly, a water supply conduit supplying water to the main reservoir, a primary water pump and pump conduit positioning the water between the main reservoir and the ice making assembly, the ice making assembly freezing a portion of the water for creating ice and excess water, an ice cube chute dispensing the ice, an excess water trough collecting the excess water, an excess water return conduit positioning the excess water from the excess water trough to the main reservoir, a wastewater discharge conduit extending from the main reservoir to a discharge aperture external to the housing, the primary water pump propelling the water through the wastewater discharge conduit upon a high water level within the main reservoir for positioning a portion of the excess water from the main reservoir and through the discharge aperture, the auxiliary water reservoir system comprising:

an auxiliary water reservoir positioning external to the housing;

an auxiliary water supply conduit supplying water to said auxiliary water reservoir;

a return conduit coupling with the wastewater discharge conduit and positioning the excess water within said auxiliary water reservoir;

an auxiliary water pump and an auxiliary pump conduit positioning the water and the excess water from said auxiliary water reservoir to the water supply conduit;

a water inlet regulator coupled to said auxiliary water supply conduit for regulating the flow of the water through said auxiliary water supply conduit;

a water level sensor within said auxiliary water reservoir for sensing the level of the water and the excess water within said auxiliary water reservoir;

an auxiliary system controller electronically coupled to said water inlet regulator and said water level sensor for opening said water inlet regulator upon said water level sensor indicating a low water level within said auxiliary water reservoir and closing said water inlet regulator upon said water level sensor indicating a high water level within said auxiliary water reservoir;

said auxiliary water pump propelling the water through said auxiliary pump conduit and the water supply conduit upon a low water level within the main reservoir for utilizing the water and the excess water through the ice making assembly and said auxiliary water pump terminating the propelling of the water and the excess water through said auxiliary pump conduit and the water supply conduit upon a high water level within the main reservoir;

an exterior housing containing said auxiliary water reservoir, said auxiliary water pump, said water inlet regulator, said water level sensor and said auxiliary system controller;

said exterior housing positioned exterior to the ice making apparatus; and said exterior housing recovering and reusing the excess water to produce ice and resulting in a reduction in the overall water usage of the ice making apparatus.

2. The auxiliary water reservoir system for coupling with the ice making apparatus as set forth in claim 1, further including a drain valve coupled to said auxiliary water reservoir for draining the water and the excess water from said auxiliary water reservoir.

3. The auxiliary water reservoir system for coupling with the ice making apparatus as set forth in claim 1, further including a UV water treatment device coupled to said auxiliary pump conduit for decontaminating the water and the excess water.

4. The auxiliary water reservoir system for coupling with the ice making apparatus as set forth in claim 1, wherein the water in the main water reservoir has a first temperature;

the excess water in said auxiliary water reservoir has a second temperature; and said second temperature being lower than said first temperature for defining a pre-chilled water and excess water mixture traveling over the ice making assembly to increase ice production and resulting in a reduction in the operating and maintenance expenses.

5. The auxiliary water reservoir system for coupling with the ice making apparatus as set forth in claim 1, further including a bypass conduit extending between said auxiliary water supply conduit and the water supply conduit for bypassing said auxiliary water reservoir;

a supply valve coupling said bypass conduit, said auxiliary pump conduit and the water supply conduit;

said auxiliary system controller electronically coupled to said supply valve for permitting water to flow either from said auxiliary water reservoir to the main reservoir or from said bypass conduit to the main reservoir; and said bypass conduit diverting the water from said auxiliary water reservoir if said auxiliary reservoir is sufficiently filed with water.

6. The auxiliary water reservoir system for coupling with the ice making apparatus as set forth in claim 1, further including an auxiliary waste water conduit for discharging the water;

a discharge valve coupling said auxiliary waste water conduit, said return conduit and the waste water;

said auxiliary system controller electronically coupled to said discharge valve for permitting water to flow either from the main reservoir to the said auxiliary water reservoir or through said auxiliary waste water conduit; and said auxiliary waste water conduit diverting the water to said auxiliary water reservoir if said auxiliary reservoir is sufficiently filed with water.

7. A process for recycling an excess water dispensed from an ice making apparatus, the ice making apparatus including a housing containing a main reservoir and an ice making assembly, a water supply conduit supplying water to the main reservoir, a primary water pump and pump conduit positioning the water between the main reservoir and the ice making assembly, the ice making assembly freezing a portion of the water for creating ice and excess water, an ice cube chute dispensing the ice, an excess water trough collecting the excess water, an excess water return conduit positioning the excess water from the excess water trough to the main reservoir, and a wastewater discharge conduit extending from the main reservoir to a discharge aperture external to the housing, the primary water pump propelling the water through the wastewater discharge conduit upon a high water level within the main reservoir for positioning a portion of the excess water from the main reservoir and through the discharge aperture, the process comprising the steps of:

securing an auxiliary water reservoir, an auxiliary water pump, a water inlet regulator, a water level sensor and an auxiliary system controller external to the housing;

coupling an auxiliary water supply conduit to said auxiliary water reservoir for supplying water;

coupling a return conduit with the wastewater discharge conduit for positioning the excess water within said auxiliary water reservoir;

positioning the water and the excess water from the auxiliary water reservoir to the water supply conduit with said auxiliary water pump and an auxiliary pump conduit;

coupling said water inlet regulator to said auxiliary water supply conduit for regulating the flow of the water through said auxiliary water supply conduit;

positioning said water level sensor within said auxiliary water reservoir for sensing the level of the water and the excess water within said auxiliary water reservoir;

coupling said auxiliary system controller electronically to said water inlet regulator and said water level sensor for opening said water inlet regulator upon said water level sensor indicating a low water level within said auxiliary water reservoir and closing said water inlet regulator upon said water level sensor indicating a high water level within said auxiliary water reservoir;

propelling the water through said auxiliary pump conduit and the water supply conduit with said auxiliary water pump upon a low water level within the main reservoir for utilizing the water and the excess water through the ice making assembly and terminating the propelling of the water through said auxiliary pump conduit and the water supply conduit with said auxiliary water pump upon a high water level within the main reservoir;

recovering the excess water in an exterior housing for storing the excess water exterior to the ice making apparatus;

reusing the excess water from said exterior housing in the ice making apparatus; and reducing overall water usage of the ice making apparatus by recovering and reusing the excess water.

8. An ice making apparatus for producing ice from water, comprising:

a housing containing a main reservoir and an ice making assembly;

a water supply conduit supplying the water to said main reservoir;

the water defining a first temperature in said main reservoir;

a primary water pump and a pump conduit positioning the water between said main reservoir and said ice making assembly;

said ice making assembly freezing a portion of the water for creating ice and an excess water;

an ice cube chute dispensing the ice;

an excess water trough collecting said excess water;

an excess water return conduit positioning said excess water from said excess water trough to said main reservoir;

a wastewater discharge conduit extending from said main reservoir to a discharge aperture external to said housing;

said primary water pump propelling the water through said wastewater discharge conduit upon a high water level within said main reservoir for positioning a portion of said excess water from said main reservoir and through said discharge aperture;

an auxiliary water reservoir positioning external to said housing;

an auxiliary water supply conduit supplying water to said auxiliary water reservoir;

a return conduit coupling with said wastewater discharge conduit and positioning said excess water within said auxiliary water reservoir;

said excess water defining a second temperature in said auxiliary water reservoir;

an auxiliary water pump and an auxiliary pump conduit positioning the water and said excess water from said auxiliary water reservoir to said water supply conduit;

a water inlet regulator coupled to said auxiliary water supply conduit for regulating the flow of the water through said auxiliary water supply conduit;

a water level sensor within said auxiliary water reservoir for sensing the level of the water and said excess water within said auxiliary water reservoir;

an auxiliary system controller electronically coupled to said water inlet regulator and said water level sensor for opening said water inlet regulator upon said water level sensor indicating a low water level within said auxiliary water reservoir and closing said water inlet regulator upon said water level sensor indicating a high water level within said auxiliary water reservoir;

said auxiliary water pump propelling the water through said auxiliary pump conduit and said water supply conduit upon a low water level within said main reservoir for utilizing the water and said excess water through said ice making assembly and said auxiliary water pump terminating the propelling of the water and said excess water through said auxiliary pump conduit and said water supply conduit upon a high water level within said main reservoir;

said second temperature being lower than said first temperature for defining a pre-chilled water and excess water mixture traveling over the ice making assembly to increase ice production and resulting in a reduction in the operating and maintenance expenses;

an exterior housing containing said auxiliary water reservoir, said auxiliary water pump, said water inlet regulator, said water level sensor and said auxiliary system controller;

said exterior housing positioned exterior to the ice making apparatus; and said exterior housing recovering and reusing the excess water to produce ice and resulting in a reduction in the overall water usage of the ice making apparatus.

9. The ice making apparatus for producing ice from water as set forth in claim 8, wherein said auxiliary water reservoir, said auxiliary water pump, said water inlet regulator, said water level sensor and said auxiliary system controller positioned within a separate and exterior housing relative to the ice making apparatus; and said separate and exterior housing is positioned in a side-by-side arrangement with the ice making apparatus for recovering and reusing the excess water and reducing the overall water usage of the ice making apparatus.

10. An ice making apparatus for producing ice from water, comprising:

a main housing containing a main reservoir and an ice making assembly;

a water supply conduit supplying water to said main reservoir;

a primary water pump and pump conduit positioning the water between said main reservoir and said ice making assembly;

said ice making assembly freezing a portion of the water for creating ice and an excess water;

an ice cube chute dispensing the ice;

an excess water trough collecting said excess water;

an excess water return conduit positioning said excess water from said excess water trough to said main reservoir;

a wastewater discharge conduit extending from said main reservoir to a discharge aperture external to said housing;

said primary water pump propelling the water through said wastewater discharge conduit upon a high water level within said main reservoir for positioning a portion of said excess water from said main reservoir and through said discharge aperture;

an auxiliary water reservoir positioning external to the housing;

an auxiliary water supply conduit supplying water to said auxiliary water reservoir;

a return conduit coupling with the wastewater discharge conduit and positioning the excess water within said auxiliary water reservoir;

an auxiliary water pump and an auxiliary pump conduit positioning the water and the excess water from said auxiliary water reservoir to the water supply conduit;

a water inlet regulator coupled to said auxiliary water supply conduit for regulating the flow of the water through said auxiliary water supply conduit;

a water level sensor within said auxiliary water reservoir for sensing the level of the water and the excess water within said auxiliary water reservoir;

an auxiliary system controller electronically coupled to said water inlet regulator and said water level sensor for opening said water inlet regulator upon said water level sensor indicating a low water level within said auxiliary water reservoir and closing said water inlet regulator upon said water level sensor indicating a high water level within said auxiliary water reservoir;

said auxiliary water pump propelling the water through said auxiliary pump conduit and the water supply conduit upon a low water level within the main reservoir for utilizing the water and the excess water through the ice making assembly and said auxiliary water pump terminating the propelling of the water and the excess water through said auxiliary pump conduit and the water supply conduit upon a high water level within the main reservoir;

an exterior housing containing said auxiliary water reservoir, said auxiliary water pump, said water inlet regulator, said water level sensor and said auxiliary system controller;

said exterior housing positioned exterior to the ice making apparatus; and said exterior housing recovering and reusing the excess water to produce ice and resulting in a reduction in the overall water usage of the ice making apparatus.

11. The auxiliary water reservoir system for coupling with the ice making apparatus as set forth in claim 10, further including a bypass conduit extending between said auxiliary water supply conduit and the water supply conduit for bypassing said auxiliary water reservoir;

a supply valve coupling said bypass conduit, said auxiliary pump conduit and the water supply conduit;

said auxiliary system controller electronically coupled to said supply valve for permitting water to flow either from said auxiliary water reservoir to the main reservoir or from said bypass conduit to the main reservoir; and said bypass conduit diverting the water from said auxiliary water reservoir if said auxiliary reservoir is sufficiently filed with water.

12. The auxiliary water reservoir system for coupling with the ice making apparatus as set forth in claim 10, further including an auxiliary waste water conduit for discharging the water;

a discharge valve coupling said auxiliary waste water conduit, said return conduit and the waste water;

said auxiliary system controller electronically coupled to said discharge valve for permitting water to flow either from the main reservoir to the said auxiliary water reservoir or through said auxiliary waste water conduit; and said auxiliary waste water conduit diverting the water to said auxiliary water reservoir if said auxiliary reservoir is sufficiently filed with water.

* * * * *